US006312088B1

(12) United States Patent
Seino

(10) Patent No.: US 6,312,088 B1
(45) Date of Patent: Nov. 6, 2001

(54) INK JET RECORDING APPARATUS

(75) Inventor: Takeo Seino, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/592,994

(22) Filed: Jun. 13, 2000

Related U.S. Application Data

(63) Continuation of application No. PCT/JP99/05610, filed on Oct. 12, 1999.

(30) Foreign Application Priority Data

Oct. 13, 1998 (JP) ..... 10-290411

(51) Int. Cl.[7] ..... B41J 2/165
(52) U.S. Cl. ..... 347/23; 347/30
(58) Field of Search ..... 347/22, 23, 29, 347/30

(56) References Cited

U.S. PATENT DOCUMENTS 5,606,353 * 2/1997 Mochizuki et al. ..... 347/30
6,019,450 * 2/2000 Mochizuki et al. ..... 347/30
6,106,097 * 8/2000 Otani et al. ..... 347/30
6,142,600 * 11/2000 Takahashi et al. ..... 347/30

FOREIGN PATENT DOCUMENTS

0778140 * 6/1997 (EP) .
8-174863 7/1996 (JP) ..... B41J/2/175
10-6527 1/1998 (JP) ..... B41J/2/175

OTHER PUBLICATIONS

International Search Report.

* cited by examiner

*Primary Examiner*—Huan Tran
(74) *Attorney, Agent, or Firm*—Sughrue, Mion, Zinn, Macpeak & Seas, PLLC

(57) ABSTRACT

When ink cartridge (1), (2) is detached and attached, kinds of mounted ink cartridge (1), (2) is judged according to ID data and data relating to ink amount in memory means (32, 42). A small amount of ink in case of brand-new ink cartridge or a relatively large amount of ink in case of remounting due to user's handling miss is sucked, so that print quality can be secured while the amount of ink consumed by the ink filling operation performed when the ink cartridge (1), (2) is mounted is being suppressed to a minimum.

12 Claims, 8 Drawing Sheets

INK JET RECORDING APPARATUS

CROSS-REFERENCE TO RELATED APPLICATIONS

This is a continuation application of International Application No. PCT/JP99/05610 filed on Oct. 12, 1999.

BACKGROUND OF THE INVENTION

This invention relates to an ink jet recording apparatus provided with a recording head for ejecting an ink droplet in response to a print signal, and a detachable and attachable ink cartridge for supplying ink to this recording head, and particularly to an ink jet recording apparatus which fills ink in the recording head accurately in accordance with detachment and attachment of the ink cartridge.

An ink jet recording apparatus is so constructed that ink to be used in a recording head can be easily supplied from a cartridge.

Therefore, it is known that by changing a kind of ink, printing of high quality is performed also on the different kind of recording medium.

In case that the kind of ink is changed like this, it is necessary to prevent deterioration of print quality due to mixture with ink remaining in the recording head. To this end, as disclosed in JP-A-10-6527, a recording apparatus has been proposed in which the kind of ink stored in the ink cartridge is detected, and in case that the kind of ink is changed, amount of ink to be filled in the recording head and a wiping operation are changed when the ink cartridge is exchanged, to thereby reliably perform the subsequent print operation.

However, the detachment and attachment of the ink cartridge is performed not only in case that the kind of ink is changed but also when ink in the ink cartridge is consumed completely, when a user remounts the ink cartridge after the user erroneously detach the ink cartridge, when a user remounts the ink cartridge after the user re-fills ink in the detached cartridge. Namely, in the detachment and attachment of the ink cartridge, various modes exist.

In case that a new ink cartridge is mounted, even if the air enters the recording head at the time of detachment and attachment, since ink which has been fully degassed is supplied from the cartridge, air bubbles that have entered the recording head are resolved in the ink reliably and disappear. Therefore, printing can be performed following a simple method, that is, merely filling a small amount of ink in the recording head. However, in case that the same cartridge is remounted, a large amount of the air enters the ink cartridge in association with the detachment of the cartridge to decrease degassed rate of the ink. For this reason, the air bubbles in the recording head is difficult to be resolved into the ink and disappear. Further, since air that has entered an ink supply port of the cartridge enters the recording head, it is necessary to discharge a large amount of ink out of the system through the recording head in order to discharge this air.

As described above, the amount of ink to be filled in the recording head after the cartridge is mounted varies depending on the ink cartridge exchanging modes. Therefore, the user must fill an optimum amount of ink in the recording head through a cleaning instruction switch provided on a control panel of the recording apparatus in accordance with the ink cartridge exchanging mode, which causes an inexperienced user to make print of intended print quality impossible or causes waste of recording sheets and ink.

Accordingly, an object of the invention is to provide an ink jet recording apparatus which can automatically select the amount of ink to be filled in the recording head and fill the ink therein in accordance with the ink cartridge exchanging mode to thereby prevent print deterioration and waste of ink associated with the detachment and attachment of the ink cartridge(s).

SUMMARY OF THE INVENTION

An ink jet recording apparatus of the invention comprises an ink jet recording head which receives ink supplied from an ink cartridge provided with memory means for storing ID data and data relating to ink amount therein in rewritable manner; suction means for recovering ink droplet ejecting performance by applying negative pressure to the recording head; means for reading out the data in said memory means and writing data therein; and control means for controlling the amount of ink sucked by the suction means in accordance with the ID data and the data relating to the ink amount in the memory means when the ink cartridge is detached and attached.

With this arrangement, when the ink cartridge is detached and attached, a kind of amounted ink cartridge is judged according to the ID data and the data relating to the ink amount in the memory means; and a small amount of ink in case of a new ink cartridge, or a relatively large amount of ink in case of remounting due to a user's miss handling is sucked, so that while amount of ink consumed in the ink filling operation as the ink cartridge is mounted is being suppressed to a minimum, print quality is secured.

The present disclosure relates to the subject matter contained in Japanese patent application No. Hei. 10-290411 (filed on Oct. 13, 1998), which is expressly incorporated herein by reference in its entirety.

BRIEF DESCRIPTION OF THE DRAWINGS

Further, FIG. 4 is a diagram showing one embodiment of memory means of the cartridge, in which

DESCRIPTION OF THE PREFERRED EMBODIMENT

The detail of the invention will be described below based on the shown embodiments.

Figure 1:
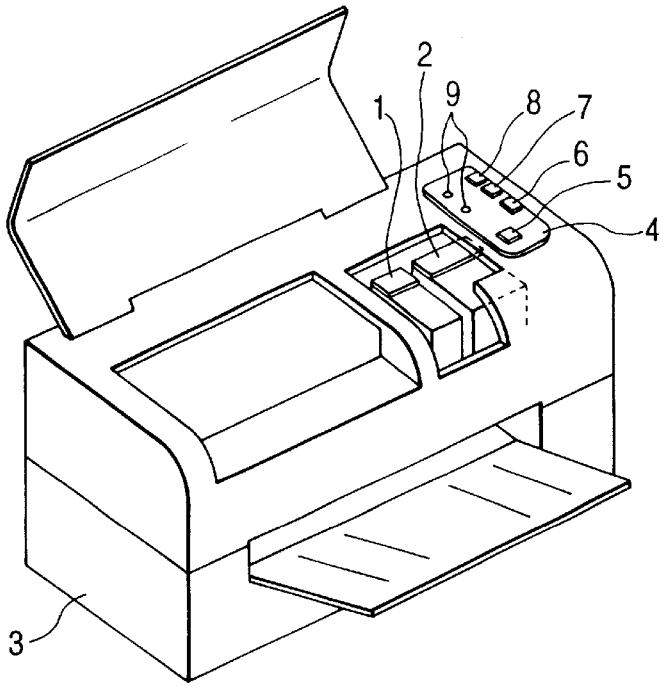
FIG. 1 is a diagram showing one embodiment of an ink jet recording apparatus of the invention.

FIG. 1 shows one embodiment of an ink jet recording apparatus of the invention, in which print mechanism to be described later is housed at a printing region in a case 3 and ink cartridges 1 and 2 are housed at a non-printing region in the case 3.

On an exposed surface of the case 3, an operation panel 4 is provided, on which there are arranged a power switch 5, an ink cartridge exchanging instruction switch 6, a cleaning instruction switch 7, a refill confirming switch 8, display means, etc.

Figure 2:
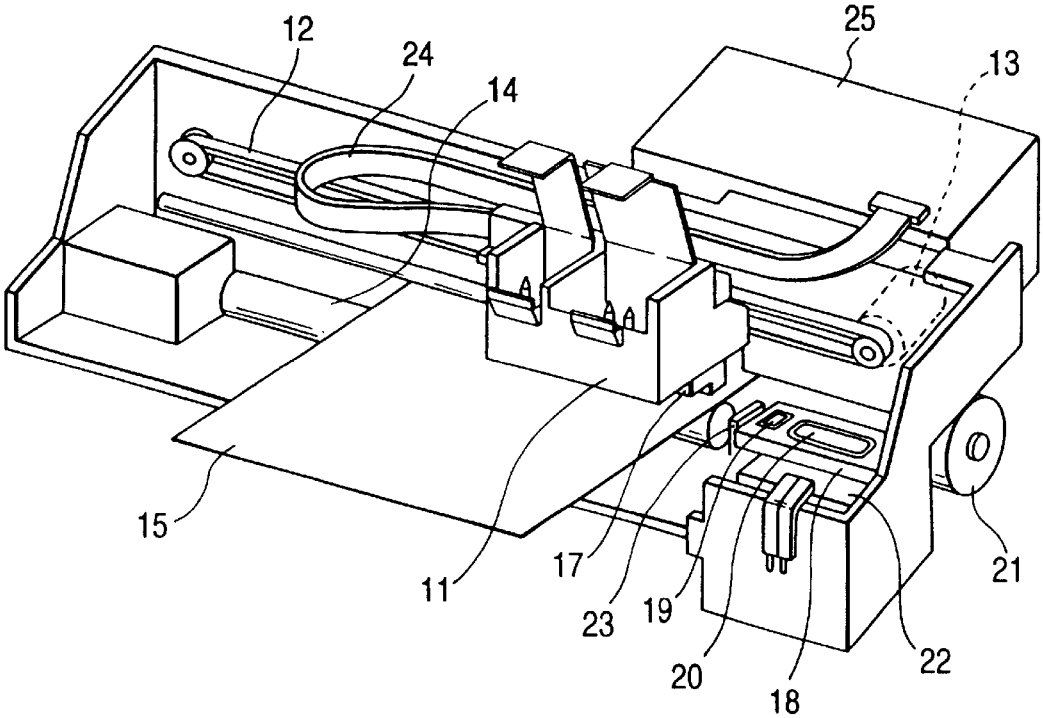
FIG. 2 is a diagram schematically showing a print mechanism of a printer of FIG. 1.

FIG. 2 schematically shows the above print mechanism. A carriage 11 is connected to a carriage driving motor 13 through a timing belt 12 to reciprocate in parallel with a platen 14. The carriage 11 includes a recording head 16 for ejecting black ink and a recording head 17 for ejecting color ink, which are provided on surfaces of the carriage 11 opposite to a recording sheet 15.

A capping unit 18 disposed at the non-printing region is so constructed that a cap 19 for sealing the black ink recording head 16 and a cap 20 for sealing the color ink recording head 17 are individually mounted on the same slider, and that each of the caps is connected through a tube to a duplex pump unit 22 driven by a motor 21 and individually receives supply of a negative pressure.

Each of the caps 19 and 20 has a size with which a corresponding nozzle opening surface of the recording head 16, 17 can be sealed in one space, and is formed in the shape of a cup made of elastic material such as rubber. The caps 19 and 20 are so designed that they can seal the nozzle opening surfaces of the recording heads 16 and 17 at the non-printing time and can cause the recording heads 16 and 17 to forcibly eject ink by the negative pressure from the pump unit 22 when a recovery operation of ejecting performance is performed or when the ink cartridges 1 and 2 are exchanged and mounted. Further, in the vicinity of the capping unit 18, a cleaning unit 23 is disposed, which brings a wiping blade into contact with the nozzle opening surfaces of the recording heads 16 and 17 by power from a driving source (not shown).

Each of the recording heads 16, 17 mounted on the carriage 11, and semi-conductive memory means provided on the ink cartridges 1, 2, to be described later are connected through a flexible cable 24 to the control device 25. The control device can read out data in the semi-conductive memory means and write data therein.

Figure 3A:
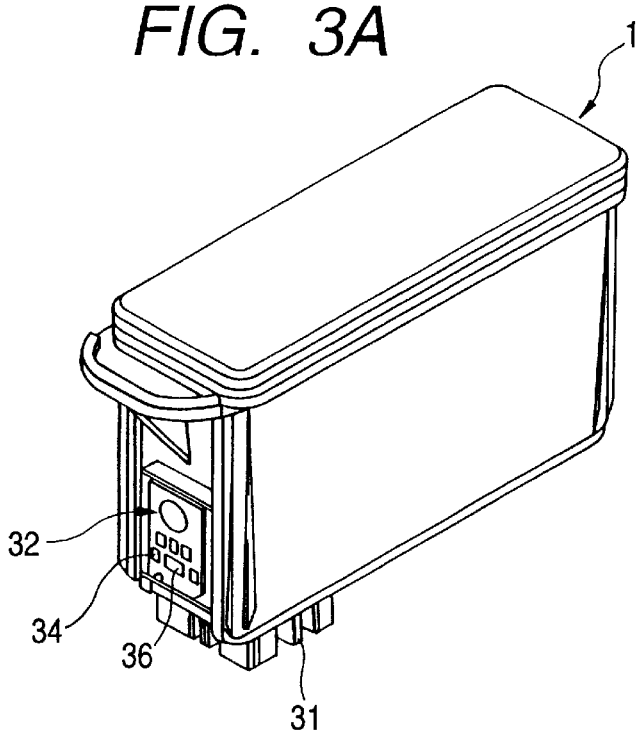
FIG. 3A is a diagram showing one embodiment of a black ink cartridge used in the printer.
Figure 3B:
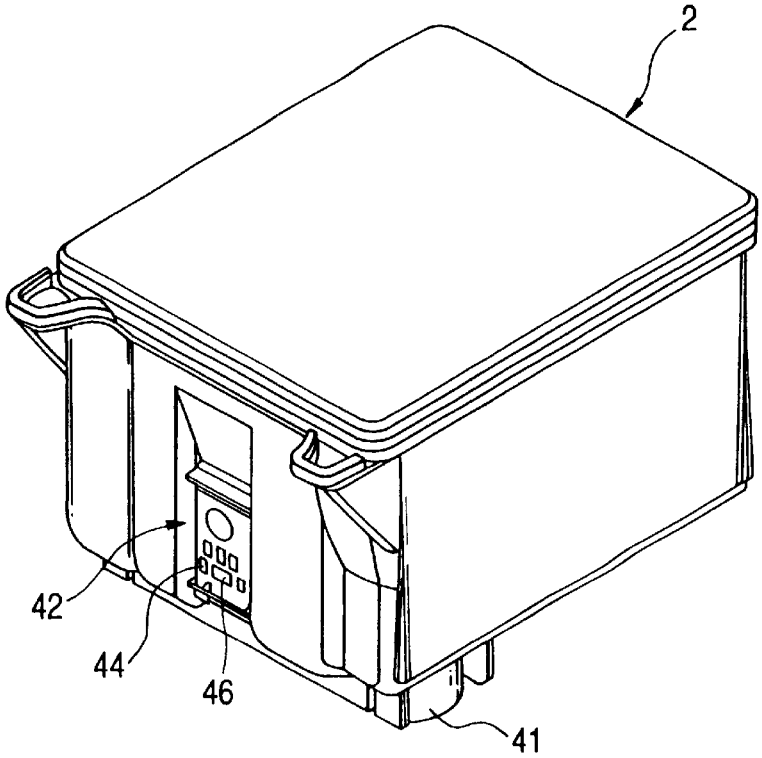
FIG. 3B is a diagram showing one embodiment of a ink cartridge used in the printer.

FIGS. 3A and 3B show one embodiment of the black ink cartridge 1 and one embodiment of the color ink cartridge 2, respectively. When the black ink cartridge 1 is mounted on the carriage 11, on a surface of the ink cartridge opposite to the carriage 11, that is, on a side surface of the ink cartridge on a side of an ink supply port 31 (41) in this embodiment, there is provided a rewritable memory means 32 (42).

Figure 4A:
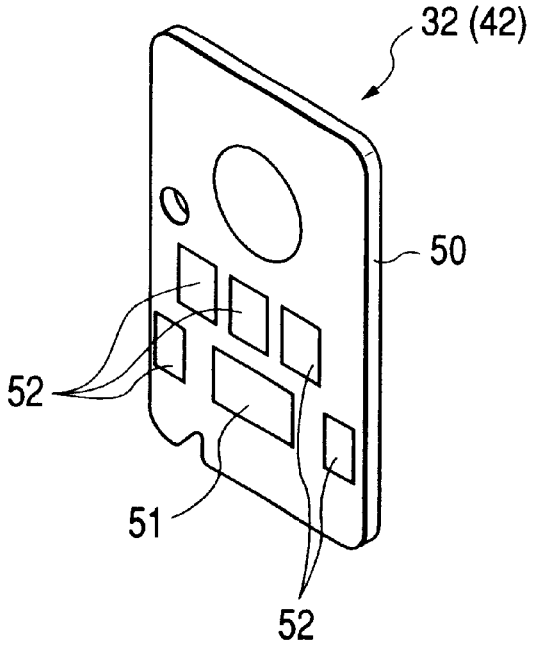
FIGS. 4A and 4B show a surface and a rear surface of a circuit substance.
Figure 4B:
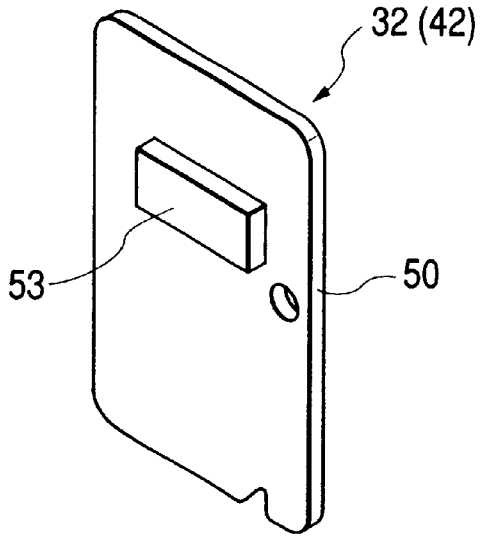
Figure 5A:
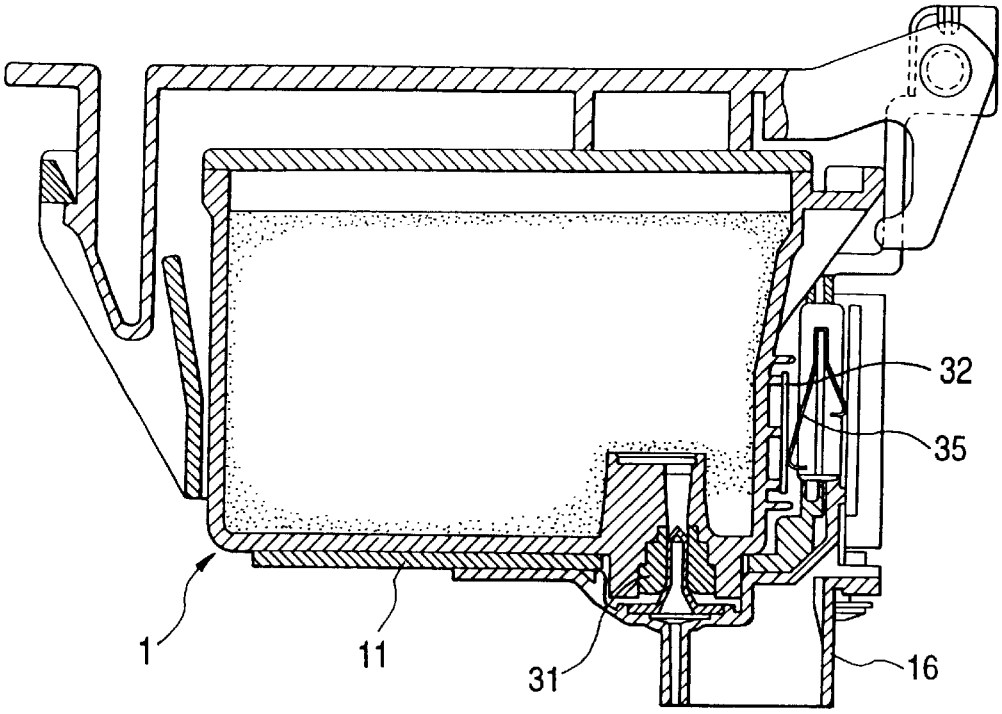
FIG. 5A is a sectional view showing a state in which the black ink cartridge is mounted.
Figure 5B:
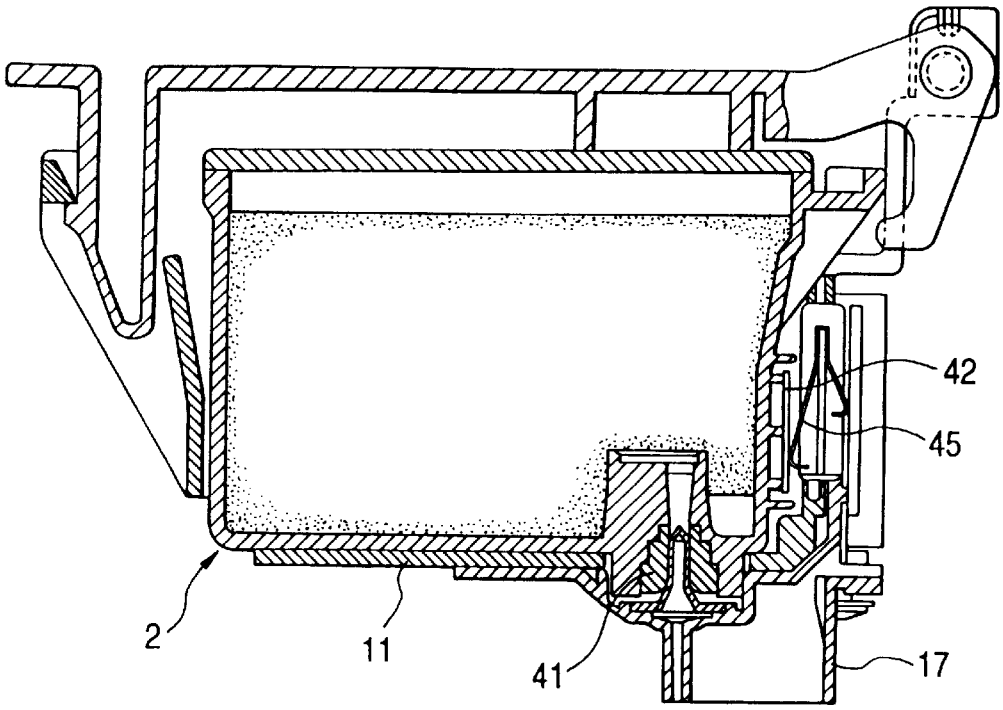
FIG. 5B is a sectional view showing a state in which the color ink cartridge is mounted.

Each of these memory means 32, 42 includes externally connectable contacts 51, 52 formed on the surface of a circuit substrate 50, and a rewritable memory element formed on the rear surface thereof, for example, a semi-conductive memory element 53 that can be electrically rewritten, as shown in FIG. 4. As shown in FIGS. 5A and 5B, the memory means 32, 42 are connected through contacts 35, 45 of the carriage 11 to the control device 25, so that the data stored in the semi-conductive memory element 53 can be read out or data in a memory means of the main body of the recording apparatus can be written into the memory element 53.

When ink cartridges are shipped from a factory, the semi-conductive memory means 32, 42 record, as fixed data that cannot be rewritten, at least ID data for specifying the ink cartridges 1, 2, and a manufacturing date of each ink cartridges. Further, in a state where the ink cartridges are mounted in the recording apparatus, the semi-conductive memory means 32, 42 secure regions for storing data relating to ink amount of the ink cartridges 1, 2, such as the amount of residual ink.

Figure 6:
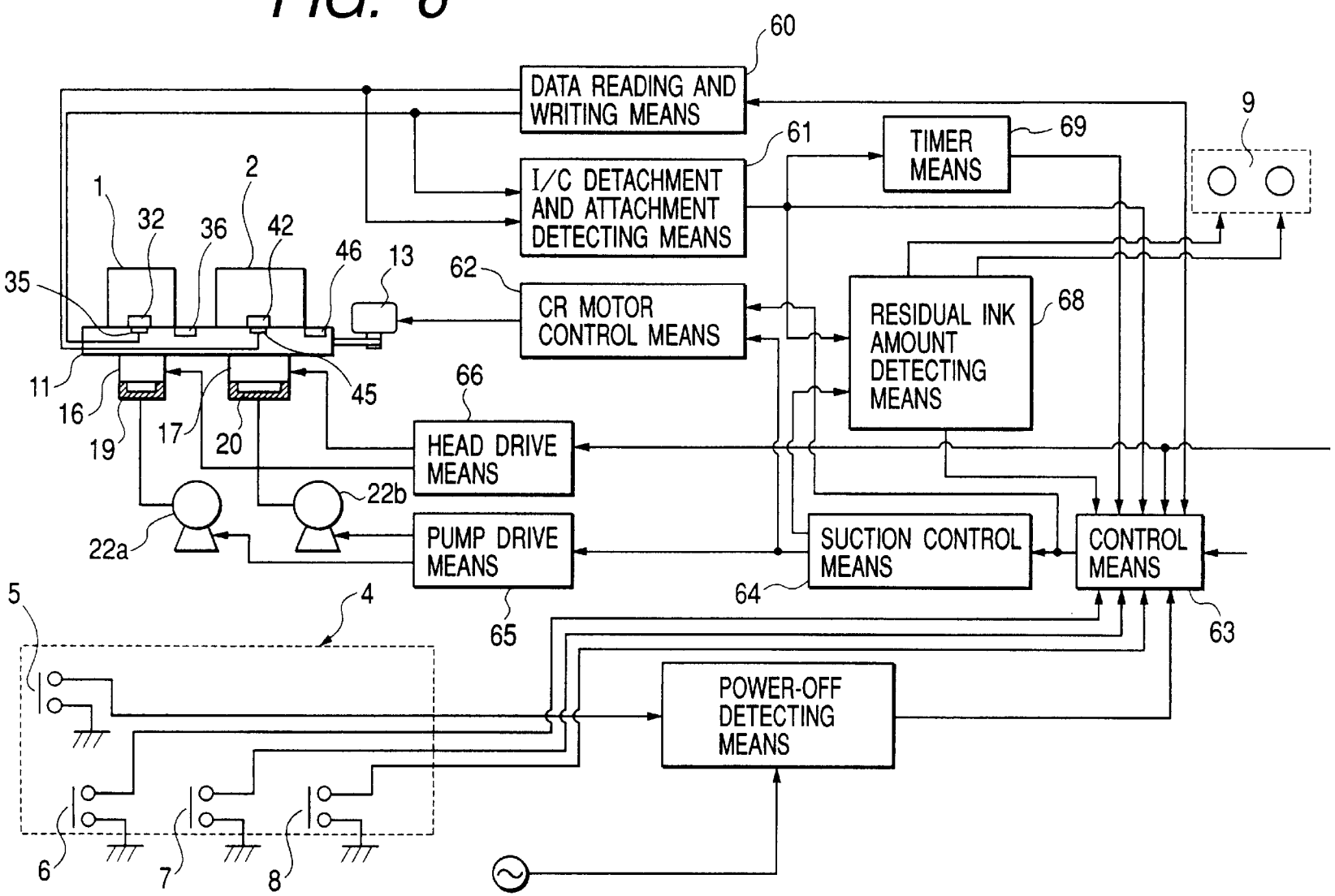
FIG. 6 is a block diagram showing one embodiment of a control device of the winter.

FIG. 6 shows one embodiment of a control device which performs an exchanging operation of the ink cartridge in the above recording apparatus and executes resolution of clogging. The control means 63 is connected through the contacts 35, 45 of the carriage 11 to the contacts 34, 44 of the ink cartridges 1, 2 to read out data in the memory means 32, 42 of the ink cartridges 1, 2 by data reading and writing means 60, and to retain the data of the mounted ink cartridges. Further, data relating to ink amount in residual ink amount detecting means 68 to be described later is written into the memory means 32, 42 of the ink cartridges 1, 2.

Ink cartridge detachment and attachment detecting means 61 is constructed as a short-circutable contact 36 (46) by an electrode 51 having a relatively large-size in the center of a substrate 50, and the means 61 is so constructed so as to detect the detachment and attachment of the ink cartridges 1, 2 by the existence of the short-circuit. In a position of the carriage 11 opposite to each ink cartridges 1, 2, that is, on a cartridge receiving surface of the carriage 11 in this embodiment, a switch pressed and operated by the ink cartridge 1 (2) may be provided.

Upon reception of control from the control means 63, carriage motor control means 62 causes the carriage 11 to reciprocate for the purpose of printing, and causes the recording heads 16, 17 to move to the position where the recording heads can be sealed by the caps at the time of the ejection recovering operation.

Upon reception of control from the control means 63, suction control means 64 causes the recording heads 16, 17 to be sealed by the capping unit 18, and causes ink to be forcibly eject from the recording heads 16, 17 while controlling suction power and suction time of each of suction pumps 22*a*, 22*b* of the pump unit 22 through pump drive means 65 in order to recover the ink ejecting performance. Further, when the ink cartridge 1, 2 is exchanged, the suction control means 64 adjusts the ink amount in accordance with the exchanging mode of the ink cartridge 1, 2 and fills ink from the ink cartridge 1, 2 to the recording head 16, 17 so that printing can be performed.

Residual ink amount detecting means 68 adds up the number of dots formed by the printing operation and the amount of ink consumed by the filling operation or the cleaning operation thereby calculating the amount of the residual ink in the ink cartridge 1, 2 or the amount of the consumed ink, and this calculated amount of ink is stored, as data relating to the ink amount, by the reading and writing means 60 in the memory means 32, 42 in the ink cartridge 1, 2.

Timer means 69 counts time for which the ink cartridge 1, 2 has not been mounted on the recording head 16, 17 in such a manner that time counting is started in case that draw of the ink cartridge 1, 2 is detected by the ink cartridge detachment and attachment detecting means 61, and stopped when the ink cartridge 1, 2 is mounted on the recording head 16, 17.

Figure 7:
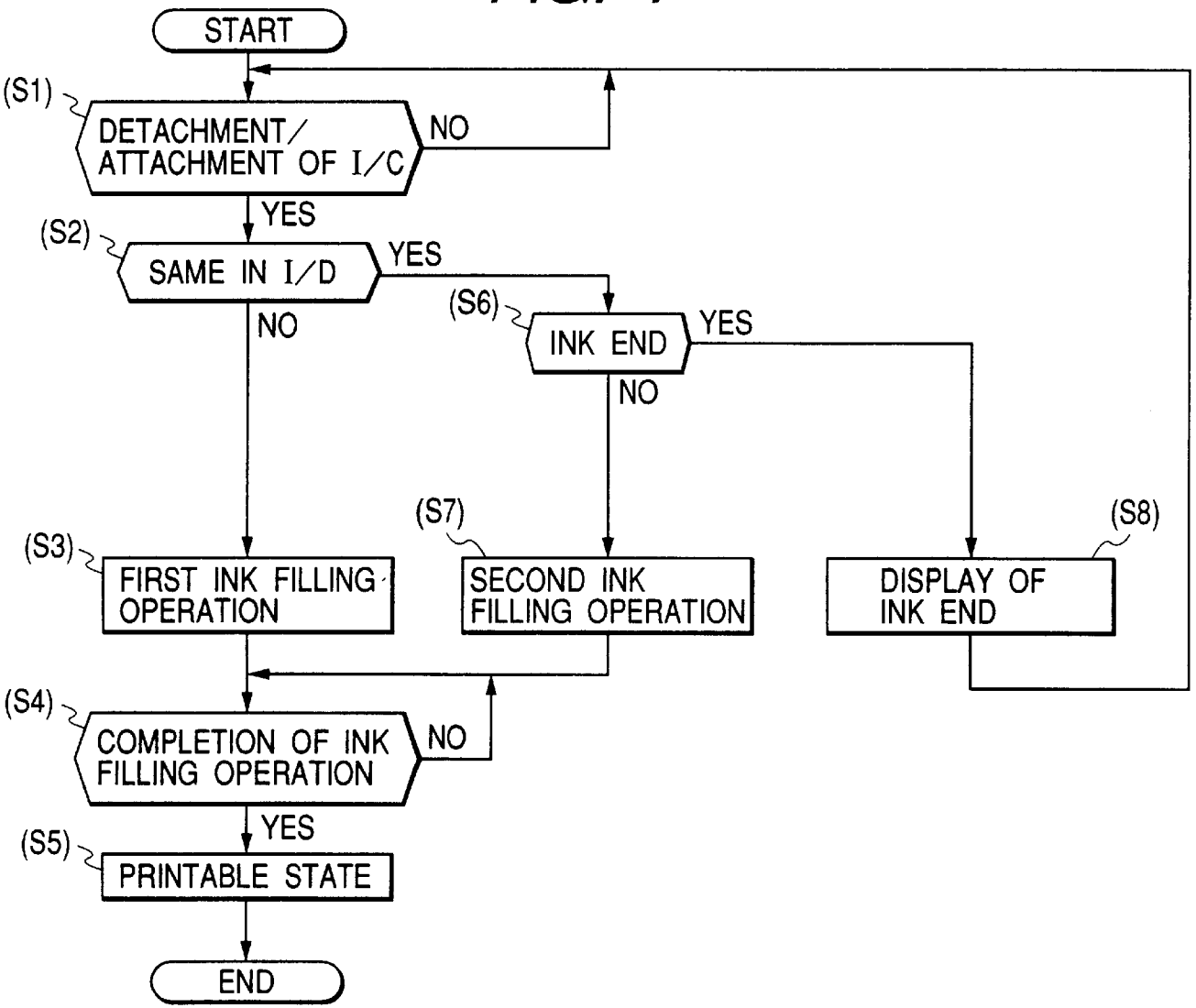
FIG. 7 is a flowchart showing a first operation mode of the control device.

FIG. 7 is a flowchart showing a first operation mode of the above apparatus.

A first filling operation is an ink filling operation in the recording head in case that the ink cartridge is exchanged to a brand-new ink cartridge 1, 2 in which fully degassed ink is filled. Ink suction amount is, for example, about 0.2 g.

A second filling operation is performed in case that the same cartridge 1, 2 is detached and attached. The degassed rate of ink in the remounted ink cartridge 1, 2 is lowered considerably than the degassed rate of ink in a brand-new ink cartridge. Further, in association with the detachment and attachment of the ink cartridge, air enters the ink supplying port of the ink cartridge 1, 2; and when the ink cartridges are remounted, the air enters the recording head 16, 17 and the ink cartridge. For this reason, the ink suction amount is set about twice to four times as large as that in the first filling operation.

In a state where the recording apparatus is switched on and the control means 63 monitors and controls the operations of the whole recording apparatus, if an instruction on exchange of the ink cartridge 1, 2 is given using the ink cartridge exchanging instruction switch 6, the control means 63 moves the carriage 11 to a cartridge exchanging position.

In this state, when the user draws out the ink cartridge 1, 2 and then mounts an ink cartridge, the ink cartridge detachment and attachment detecting means 61 detects the detachment and attachment of the ink cartridge 1, 2 (step S1). The control means 63 compares ID data of the last ink cartridge 1, 2 with ID data of the mounted ink cartridge 1, 2 (step S2).

In case that the ID data is different from each other, the control means 63 judges that a brand-new ink cartridge is mounted, and causes the suction control means 64 to execute the first filling operation (step S3). Needless to say, fully degassed ink is stored in the new ink cartridge and the ink supply port is sealed with a film. Therefore, almost no air enters the recording head and the ink cartridge in association with the mounting of the new ink cartridge 1, 2, and also the rate of solving air into ink is high, so that filling of a small amount of ink in the recording head 16, 17 (step S4) makes printing possible (step S5). The amount of the ink consumed by this ink filling operation is detected by the residual ink amount detecting means 68, and written, as data relating to the ink amount, into the memory means 32, 42 of the ink cartridge 1, 2 at an appropriate timing.

On the other hand, in case that it is detected that the ID data of the mounted ink cartridge 1, 2 is the same as that of the ink cartridge 1, 2 drawn-out immediately before the mounting, the control means 63 judges that the ink cartridge 1, 2 is detached and the same ink cartridge 1, 2 is attached, and detects the amount of the residual ink in accordance with the data in the memory means 32, 42 of the ink cartridge 1, 2 (step S6). In case that the ink remains in the remounted ink cartridge 1, 2, the second filling operation is executed (step S7).

As described above, since the film for sealing the ink supply port 31, 41 in the ink cartridge that have been once mounted in the recording head 16, 17 are torn, air enters in the vicinity of the ink supply port 31, 41 when the ink cartridge is drawn out, and this air is pushed into the recording head 16, 17 and the ink cartridge 1, 2 when the ink cartridge is remounted. Further, the degassed rate of the ink in the ink cartridge 1, 2 is lowered largely.

Accordingly, the second filling operation is executed such that a larger amount of ink than in the first filling operation is filled in the recording head 16, 17 (step S7). By thus filling a large amount of ink in the recording head 16, 17, the air bubbles remaining in the recording head 16, 17 and in the vicinity of the ink supply port of the ink cartridge 1, 2 can be reliably discharged by flow of ink.

In case that the ink cartridge 1, 2 of the same ID is remounted and ink end is detected, the ink end is displayed (step S8), the procedure returns to the step S1, and mounting of another ink cartridge 1, 2 is awaited.

In case that the ink in the ink cartridge 1, 2 is consumed completely, a user may detach the ink cartridge, fill refill ink in the cartridge, and then remount the refilled cartridge.

Figure 8:
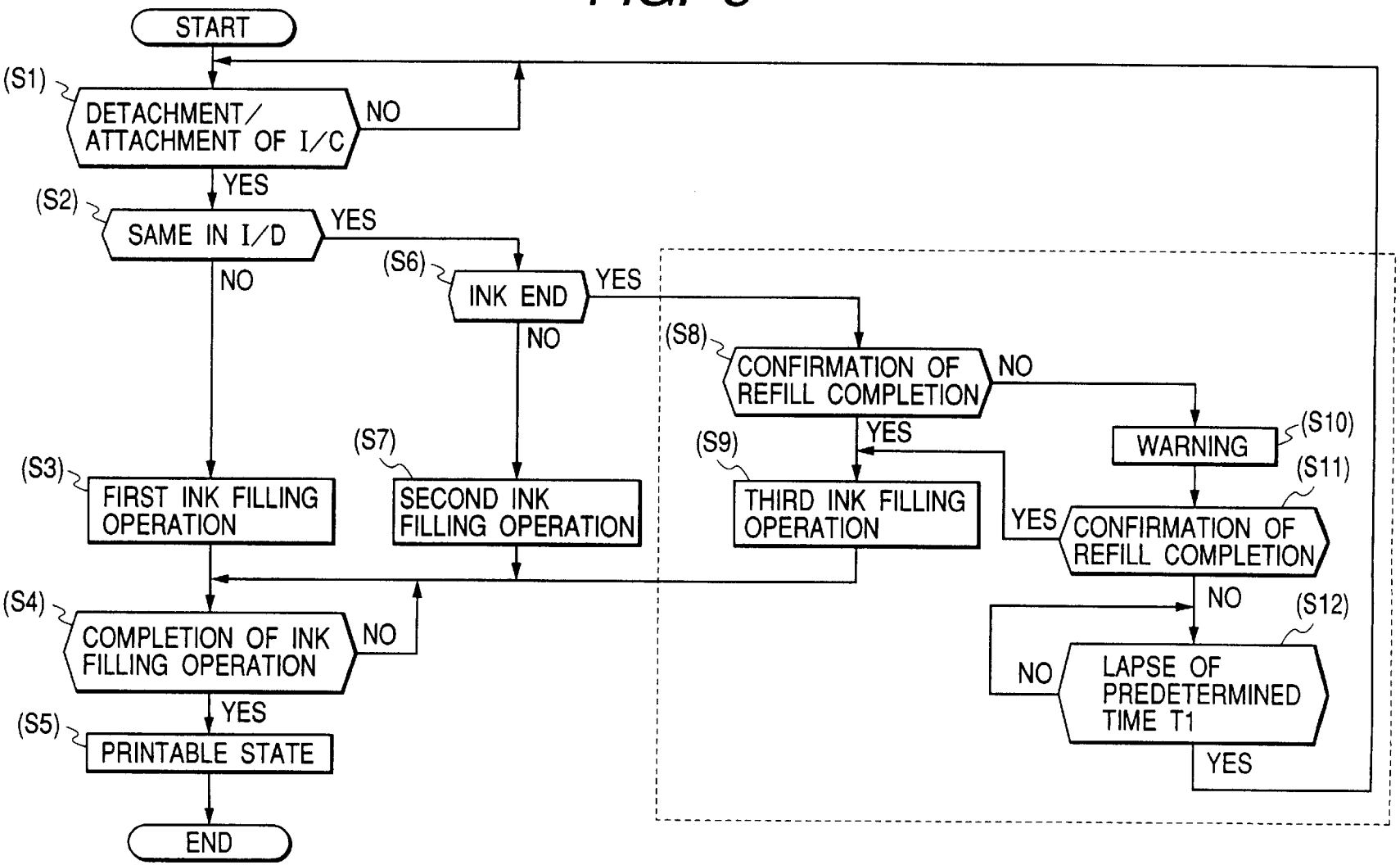
FIG. 8 is a flowchart showing a second operation mode of the control device.

In case that the ink cartridge 1, 2 of the same ID is remounted once the ink end is detected, possibility of remounting of the refilled ink cartridge 1, 2 is high. For this reason, as shown in FIG. 8, the control means 63 awaits user's refill confirmation, that is, an operation of a refill confirmation switch 8. In case that the refill confirmation is obtained (step S8), the third ink filling operation is executed (step S9).

In the refilled ink cartridge, particularly of a type in which an ink retaining porous member is filled for the purpose of preventing ink leakage and pressure variation due to movement of ink caused by reciprocating motion of the carriages 1, 2, air enters fine cells at the time when the ink is completely consumed, and therefore, even if the ink is refilled, a large amount of air bubbles exist in the ink cartridge 1, 2 and air resolves in the ink in a saturation state.

Accordingly, a larger amount of ink than in case that the same cartridge 1, 2, is simply remounted, that is, ink amount that is generally three to five times as large as the amount of ink by the first filling operation is filled in the recording head 16, 17, in order to surely discharge a large amount of the air bubbles that have entered the recording head 16, 17.

In case that no refill confirmation is obtained from the user, a warning is given (step S10) to require reconfirmation of the refill. In case that the confirmation has been obtained, the aforementioned third filling operation is executed (step S9). In case that the confirmation is not obtained within a fixed time period (step S12), the procedure returns to the step S1 and awaits detaching and attaching operation of the ink cartridge 1, 2. This prevents unrecoverable damage of the recording head associated with execution of ink filling in a state that the ink cartridge 1, 2 in which ink do not exist is mounted.

Figure 9:
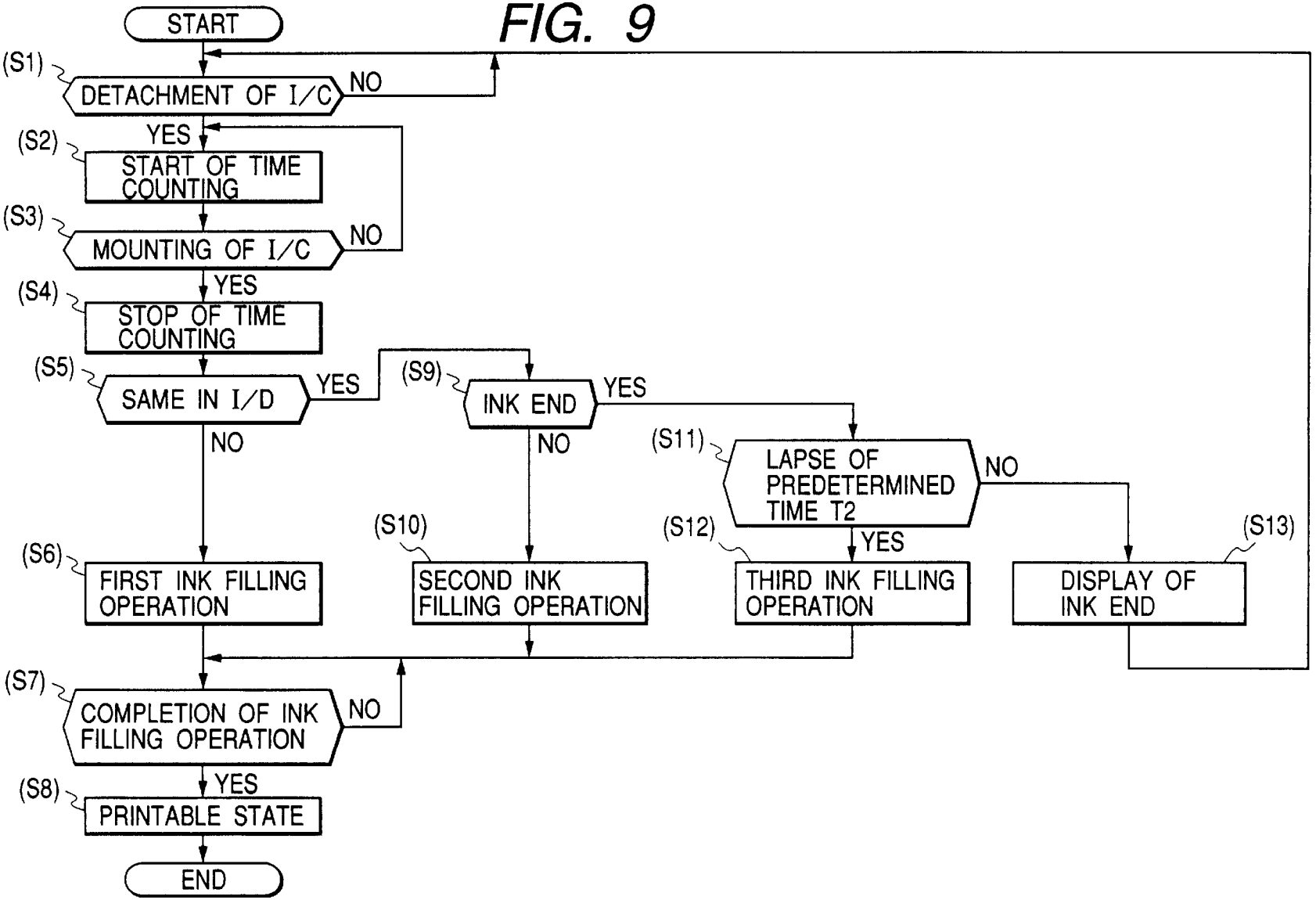
FIG. 9 is a flowchart showing a third operation mode of the control device.

FIG. 9 shows another embodiment of the invention. When the ink cartridge detachment and attachment detecting means 61 detects that ink cartridge 1, 2 is drawn out (step S1), the timer means 69 is actuated. When the ink cartridge 1, 2 is mounted and the ink cartridge detachment and attachment detecting means 61 detects that ink cartridge 1, 2 is mounted (step S3), the time counting operation of the timer means 69 is stopped (step S4), and ID data of the last ink cartridge 1, 2 is compared with ID data of the mounted ink cartridge 1, 2 (step S5).

In case that the ID data are different from each other, it is judged that a brand-new ink cartridge 1, 2 is mounted, and the first ink filling operation is executed (step S6). Filling of a small amount of ink in recording head 16, 17 (step S7) makes printing operation available (step S8).

On the other hand, in case that it is detected that the ID data of the mounted ink cartridge 1, 2 is the same as that of the ink cartridge 1, 2 drawn out immediately before the mounting (step S5), it is judged that the same ink cartridge 1, 2 is detached and attached, and the amount of the residual ink of the ink cartridge 1, 2 (step S6) is detected (step S9). In case that the ink remains in the remounted ink cartridge 1, 2, the second filling operation is executed (step S10).

In case that ink end is detected and the time period counted by the timer means 69 exceeds a predetermined time T2, for example, thirty minutes, necessary to refill ink in the ink cartridge 1, 2 (step S11), it is judged that the same ink cartridge 1, 2 in which ink has been refilled is mounted, and the third ink filling operation is exexuted accordingly (step S12).

In case that the ink cartridge is remounted for a shorter time period than the time period necessary for the refilling operation, ink end is displayed (step S13) and mounting of another ink cartridge 1, 2 is awaited (step S1).

As described above, an ink jet recording apparatus of the invention comprises: an ink jet recording head which receives ink supply from an ink cartridge provided with memory means storing ID data and data relating to ink amount therein in an rewritable manner; suction means for recovering ink droplet ejecting performance by applying negative pressure to the recording head; means for reading out the data in the memory means and writing data into the memory means; and control means for controlling the amount of ink to be sucked by the suction means in accordance with the ID data and the data relating to the ink amount in the memory means when the ink cartridge is detached and attached. Therefore, a small amount of ink in case that the mounted ink cartridge is new or a relatively large amount of ink in case of remounting due to user's handling miss is sucked, so that print quality can be secured while the amount of ink consumed by the ink filling operation performed when the ink cartridge is mounted is being suppressed to a minimum.

What is claimed is:

1. An ink jet recording apparatus comprising: an ink jet recording head which receives ink supply from an ink cartridge provided with memory means storing ID data and data relating to ink amount therein in rewritable manner; suction means for recovering ink droplet ejecting performance by applying negative pressure to the recording head; means for reading out the data in said memory means and writing data into said memory means; and control means for controlling an amount of ink to be sucked by said suction means in accordance with the ID data and the data relating to the ink amount in said memory means when said ink cartridge is detached and attached.

2. The ink jet recording apparatus according to claim 1, wherein said control means judges exchanging to a new ink cartridge or remounting of the ink cartridge detached immediately before the mounting, in accordance with the data in said memory means, and controls the amount of ink to be sucked by said suction means according to a result of this judgment.

3. The ink jet recording apparatus according to claim 1, wherein in case that ID data of a mounted ink cartridge is the same as that of the last ink cartridge, said control means detects data relating to the ink amount of the mounted ink cartridge; and in case that ink end is detected, the control means awaits an instruction from a user and determines said ink suction amount.

4. The ink jet recording apparatus according to claim 1, wherein in case that ID data of a mounted ink cartridge is the same as that of the last ink cartridge, said control means detects data relating to the ink amount of the mounted ink cartridge; and in case that ink end is detected, the control means determines said ink suction amount in accordance with time period from detachment of the ink cartridge to attachment thereof.

5. A method of varying an amount of ink to be sucked from an ink jet recording head to which a first ink cartridge having a first rewritable memory is attached after a second ink cartridge having a second rewritable memory is detached from the ink jet recording head wherein the first ink cartridge may be identical to the second ink cartridge, said method comprising the steps of:

reading ID data from the second memory and retaining the ID data;

reading ID data from the first memory, and comparing the ID data read from the first memory with the retained ID data read from the second memory;

sucking a first amount of ink from the ink jet recording head if the ID data read from the first memory is different from the retained ID data;

reading, from the first memory, data on ink amount remaining in the first ink cartridge to determine whether or not ink end has been applied to the first ink cartridge, if the ID data read from the first memory is identical to the retained ID data read from the second memory; and sucking a second amount of ink from the ink jet recording head if the ink end has not been applied to the first ink cartridge, said second amount being larger than said first amount.

6. The method according to claim 5, further comprising the step of:

indicating the ink end if the ink end has been applied to the first ink cartridge.

7. The method according to claim 5, further comprising the step of:

awaiting user's instruction as to whether or not the first ink cartridge has been refilled or not, if the ink end has been applied to the first ink cartridge.

8. The method according to claim 7, further comprising the step of:

sucking a third amount of ink from the ink jet recording head if the user's instruction that the first ink cartridge has been refilled is obtained, the third amount being larger than the second amount.

9. The method according to claim 7, further comprising the step of:

suspending sucking of ink from the ink jet recording head if the user's instruction that the first ink cartridge has been refilled is not obtained.

10. The method according to claim 6, further comprising the step of:

counting a time period from a time point at which the first ink cartridge is detached from the ink jet recording head to a time point at which the first ink cartridge is attached to the ink jet recording head after the ink end is indicated.

11. The method according to claim 10, further comprising the step of:

sucking a third amount of ink from the ink jet recording head if the time period thus counted is longer than a predetermined time period, the third amount being larger than the second amount.

12. The method according to claim 10, further comprising the step of:

suspending sucking of ink from the ink jet recording head if the time period thus counted is shorter than a predetermined period.

* * * * *